US006408777B1

(12) United States Patent
Beauchamp

(10) Patent No.: US 6,408,777 B1
(45) Date of Patent: Jun. 25, 2002

(54) SIDE THRUSTER PERFORMANCE IMPROVEMENT WITH SPEED CONTROL

(75) Inventor: Charles H. Beauchamp, Jamestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/842,703

(22) Filed: Apr. 26, 2001

(51) Int. Cl.[7] ..... B63H 25/00
(52) U.S. Cl. ..... 114/151; 440/47
(58) Field of Search ..... 114/150, 151; 440/38, 47

(56) References Cited

U.S. PATENT DOCUMENTS 6,164,230 A * 12/2000 Beauchamp ..... 114/151

* cited by examiner

*Primary Examiner*—Jesus D. Sotelo
(74) *Attorney, Agent, or Firm*—Michael J. McGowen; Prithvi C. Lall; Michael F. Oglo

(57) ABSTRACT

The present invention having enhanced maneuverability that has hull at least partially submerged in fluid, which will ordinarily be water. The vehicle has a forward bow, a longitudinal axis extending rearwardly from said bow and opposed first and second sides. The first and second sides have respectively a first major opening and a first small opening and a second opening. A fluid-conducting tunnel extends generally transversely through the hull from the first major opening on the first side of the hull to the second major opening on the said side of the hull. There is a propeller for causing fluid to flow through the tunnel. In order to compensate for the detrimental effect on thrust (T) caused by increases in forward vehicle velocity (Vv), angular speed (N) of the propeller is increased proportionally to measured increases in axial fluid velocity (Vx).

20 Claims, 2 Drawing Sheets

SIDE THRUSTER PERFORMANCE IMPROVEMENT WITH SPEED CONTROL

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED PATENT APPLICATIONS

Not applicable.

BACKGROUND OF THE INVENTION (1) Field of the Invention

The present invention relates to marine vehicles and more particularly to lateral thrusters for use therein.

(2) Description of the Prior Art

Marine vehicles often are required to maneuver at very low speeds and hover in currents. Marine vehicles typically use rudders or other control surfaces to produce maneuvering forces. However, flow over the control surfaces is required to produce a maneuvering force and these forces vary with the square of the vehicle speed. Therefore, at low speed, control surfaces become ineffective. Typically, lateral tunnel thrusters are located in the bow or stern of marine vehicles to meet the low speed maneuvering requirements. However, the effectiveness of tunnel thruster decreases with forward velocity of the vehicle. Often there is an intermediate vehicle speed at which neither the control surfaces nor the thruster produce effective maneuvering forces.

Conventionally, thrusters make use of a rotating propeller in a tunnel through the vehicle. The rotating propeller creates a pressure differential across the blades and drives a jet of water through the tunnel and out one side. The integrated pressure force on the blades is transferred to the vehicle via the rotor hub and force acting in the opposite direction of the jet flow. This effect is used to maneuver the vehicle. In the current art thrusters are designed to be reversible and so that the vehicle may be maneuvered in either port or starboard directions. For most applications, thrusters are designed which are reversible so that the vehicle may be maneuvered in either port or starboard directions.

Early efforts to measure the effects of forward vehicle velocity on tunnel thruster performance have shown that as the forward velocity was increased to speed on the order of 3 knots, the effective side force (force perpendicular to the vehicle axes) from the tunnel thruster decreased to as low as 10 percent of the side force measured at zero maneuvering effectiveness as forward vehicle velocity. Thus with the current art tunnel thruster quickly lose their maneuvering effectiveness as forward vehicle velocity increases.

Experiments conducted to understand this phenomenon indicated that the forward velocity on the vehicle significantly increases fluid velocity through the tunnel for a fix rotor speed. This results in the propeller blade operating off design and unloading the blades, which results in less thrust on the vehicle.

Tunnel thrusters are typically reversible. That is, the blades can be rotated clockwise or counter clockwise to produce a jet in either direction to maneuver the vehicle. Thus any device that is deployed to mitigate the effects of forward velocity must also be reversible.

Various specific arrangements of tunnel thrusters are shown in the prior art.

U.S. Pat. No. 3,686,485 to Wiley et al. discloses a method and apparatus for controlling the thrust delivered by each propeller of a marine propulsion system of the type having a plurality of controllable pitch propellers driven by a common power source. In response to electrical signals supplied to define commanded thrust levels for the propellers, the power source is controlled to provide the power necessary to satisfy the power requirements of the propulsion system and the propeller pitches are individually set so that each propeller absorbs only its proportionate share of the power.

U.S. Pat. No. 3,895,598 to Blickle discloses a ship propulsion unit comprised of a variable pitch propeller supported in a hub mounted on the lower end of a hollow member which is pivotably supported in a fixed housing such that the hollow member and hub are both pivotable about a vertical axis. A coaxial drive shaft for the propeller is enclosed within the hollow element. A plurality of pairs of sealing rings are provided between the hollow member and a portion of said fixed housing to define a plurality of annular chambers through which pass a number of supply and return lines for several fluid pressure systems which lead to the propeller and a servo motor for adjusting the pitch of the propeller blades.

U.S. Pat. No. 4,055,947 to Gongwer discloses an axial flow turbomachinery having an impeller with a plurality of contoured blades mounted within a diffuser throat and about a central rotatable hub. This blade shape is defined by the ratio of the blade root and tip chords to the minimum midsection blade chord, which is between about 1.25 and about 2.25. The ratio of the blade pitch at the root and tip sections as compared with the blade midsection pitch is preferably between about 1.0 and about 1.4.

U.S. Pat. No. 4,470,364 to Kitaura et al. discloses a side thruster for a ship, which includes a propeller mounted in a cylindrical tunnel formed on the ship, and a housing-support is connected between the propeller and the hull of the ship for supporting the propeller in the tunnel. The housing-support extends substantially transversely of the direction of water flow through the tunnel, and it is generally elliptical in cross section. At least one enlargement is firmed on the outer surface of the housing-support for reducing the effect of Karman vortexes, and the enlargement preferably spirals around the outer surface of the housing-support.

U.S. Pat. No. 5,226,844 to Muller discloses a drive for a boat with a propeller hub rotatable about a main axis extending in a normal travel direction, a plurality of blades projecting generally radially of the main axis from the hub and each pivotal so as to be of variable pitch, and respective blade rods extending axially and displaceable axially relative to the hub to vary the pitch in the direction from the hub and nonrotatable about the axis rotatably supports a cylinder housing that is releasably connected to the rods for joint axial movement therewith. A piston displaceable along the axis in the cylinder is releasably connected to the hob for joint axial movement therewith. Pressurizable lines extending through the stator are connected to the cylinder for alternately pressurizing the piston and thereby relatively axially shifting the rods and hub.

U.S. Pat. No. 5,249,992 to Schneider discloses an integral marine propulsion unit utilizing both collective and cyclic propeller blade pitch angle variations to generate a thrust vector in any of three degrees of motion for use with both the submersible and surface marine vessels. The present marine propulsion unit eliminates the need for extraneous drag generating control surfaces and rudders for motion control of a marine vessel by incorporating a flat plate mechanism which includes an Oldham coupler to a pair of plates and a slotted plate coupled with one of the plates. The slotted plate and the one plate coupled to the slotted plate are relatively rotatable about a fixed axis. The flat plate mechanism permits relative angular displacement between the slotted plate and the one plate to collectively pivot all of the propeller blades and permits radial movement of the clotted plate along with propeller blades.

U.S. Pat. No. 5,501,072 to Plancich et al. discloses a thrust propulsion mechanism for a boat including an outlet conduit extending athwartships from a first outlet port in the hull. A paddle-wheel impeller is mounted within the hull for rotation about an axis of rotation by a reversible motor. A circumferential paddle portion of the paddle-wheel impeller extends into an aperture defined centrally in the top wall of the outlet conduit. An inlet conduit extends athwartships form a first inlet port to a second inlet port, and intermediate thereof supplies water to the center of the paddle-wheel impeller. Water is discharged from the paddle-wheel impeller through one of the outlet ports, dependent on the direction of rotation of the paddle-wheel impeller, to create thrust by a combined paddle wheel and centrifugal pump action.

U.S. Pat. No. 5,522,335 to Veronesi et al. discloses an auxiliary thruster for a marine vessel. The auxiliary thruster includes a submersible propulsion unit which has a shroud with a propeller rotatably mounted therein. A canned electric motor is mounted between the propeller and the shroud for rotating the propeller to create thrust. A propulsion unit deploying and rotating mechanism is mounted on the hull and on the propulsion unit. The propulsion unit deploying and rotating mechanism is operable to extend the propulsion unit out of the hull and retract it into the hull and to rotate the propulsion unit to direct the thrust generated thereby in any desired direction when the thruster is in the deployed position. When the thruster is retracted, it is positioned with a tunnel extending transversely through the hull. Rotation of the propeller while in the retracted position generates laterally directed thrust through the tunnel.

SUMMARY OF THE INVENTION

An object of this invention is to improve the control performance of tunnel thrusters at intermediate forward speeds and thus fill the gap in maneuvering effectiveness.

The present invention is a marine vehicle having enhanced maneuverability that has hull at least partially submerged in fluid, which will ordinarily be water. The vehicle has a forward bow, a longitudinal axis extending rearwardly from said bow and opposed first and second sides. The first and second sides have respectively a first major opening and a first small opening and a second opening. A fluid-conducting tunnel extends generally transversely through the hull from the first major opening on the first side of the hull to the second major opening on the said side of the hull. There is a propeller for causing fluid to flow through the tunnel. In order to compensate for the detrimental effect on thrust caused by increases in forward vehicle velocity (Vv), rotor speed (N) of the propeller is increased proportionally to measured increases in axial fluid velocity (Vx).

BRIEF DESCRIPTION OF THE DRAWINGS

Other objects, features and advantages of the present invention will become apparent upon reference to the following description of the preferred embodiments and to the drawing, wherein corresponding reference characters indicate corresponding parts in the drawing and wherein.

DESCRIPTION OF THE PREFERRED EMBODIMENT

Figure 1:
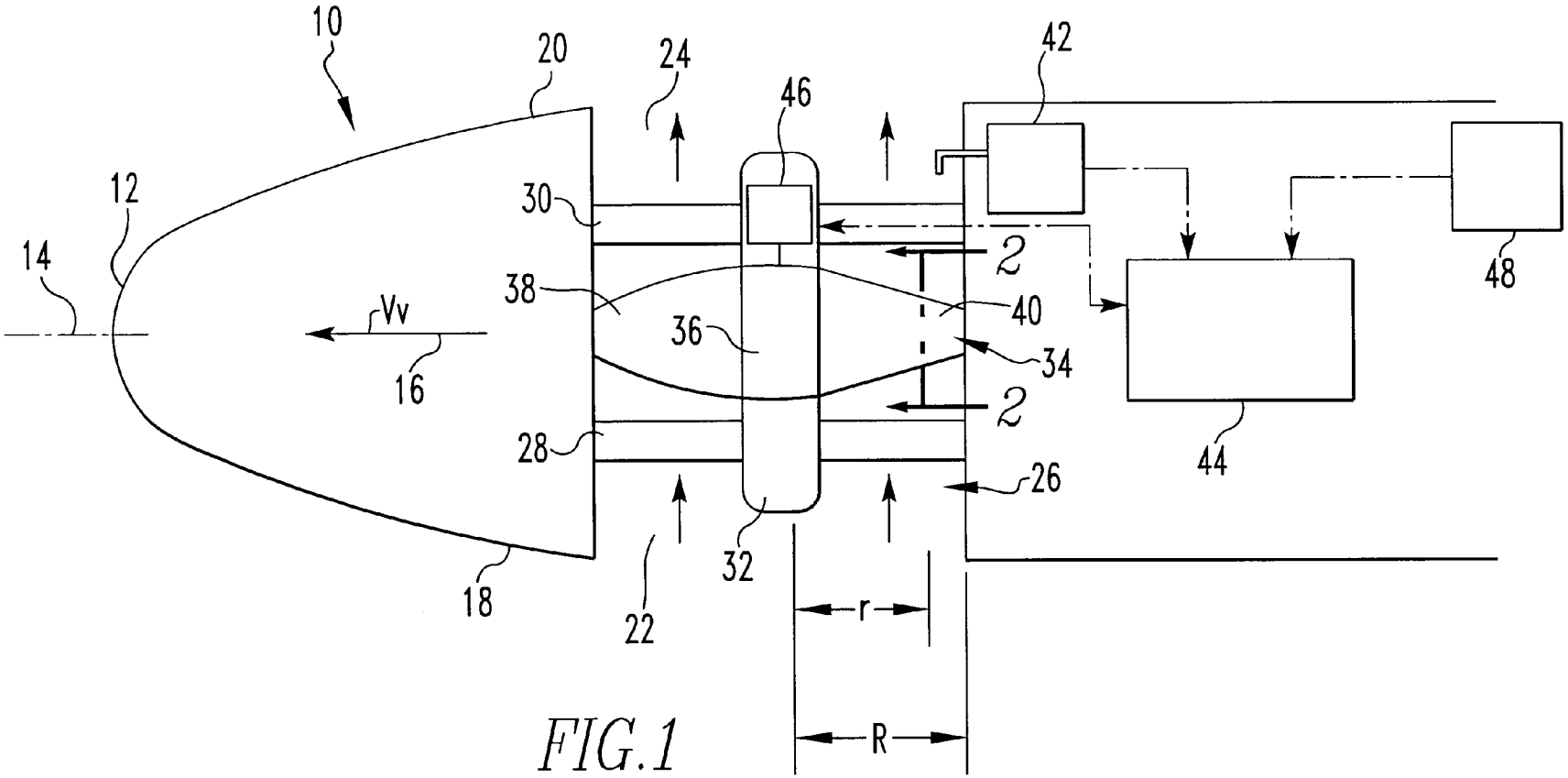
FIG. 1 is a horizontal cross sectional view of a preferred embodiment of the marine vehicle of the present invention.

Referring to FIG. 1, the marine vehicle has a hull 10 with a bow 12 from which a longitudinal axis 14 extends in an aft direction. The ordinary forward movement of the vehicle is in direction of arrow 16 in the direction of bow 12. Hull 10 has a first side 18 and a second side 20. On first side 18 there is a first opening 22, and in the second side 20 there is an opening 24. Tunnel 26 extends between such first opening 22 and second opening 24. Medially positioned in the tunnel 26 there are parallel transverse supports, 28 and 30, which are connected by a longitudinal axle 32. Positioned between the transverse supports 28 and 30, there is a propeller 34 which is comprised of a hub 36 mounted on the axle 32 and a plurality of blades as at blades 38 and 40. A fluid velocity-measuring device 42 is installed in the tunnel. There is also a speed control computer 44, which is connected to a commanded motor 46, which drives propeller 34.

Figure 2:
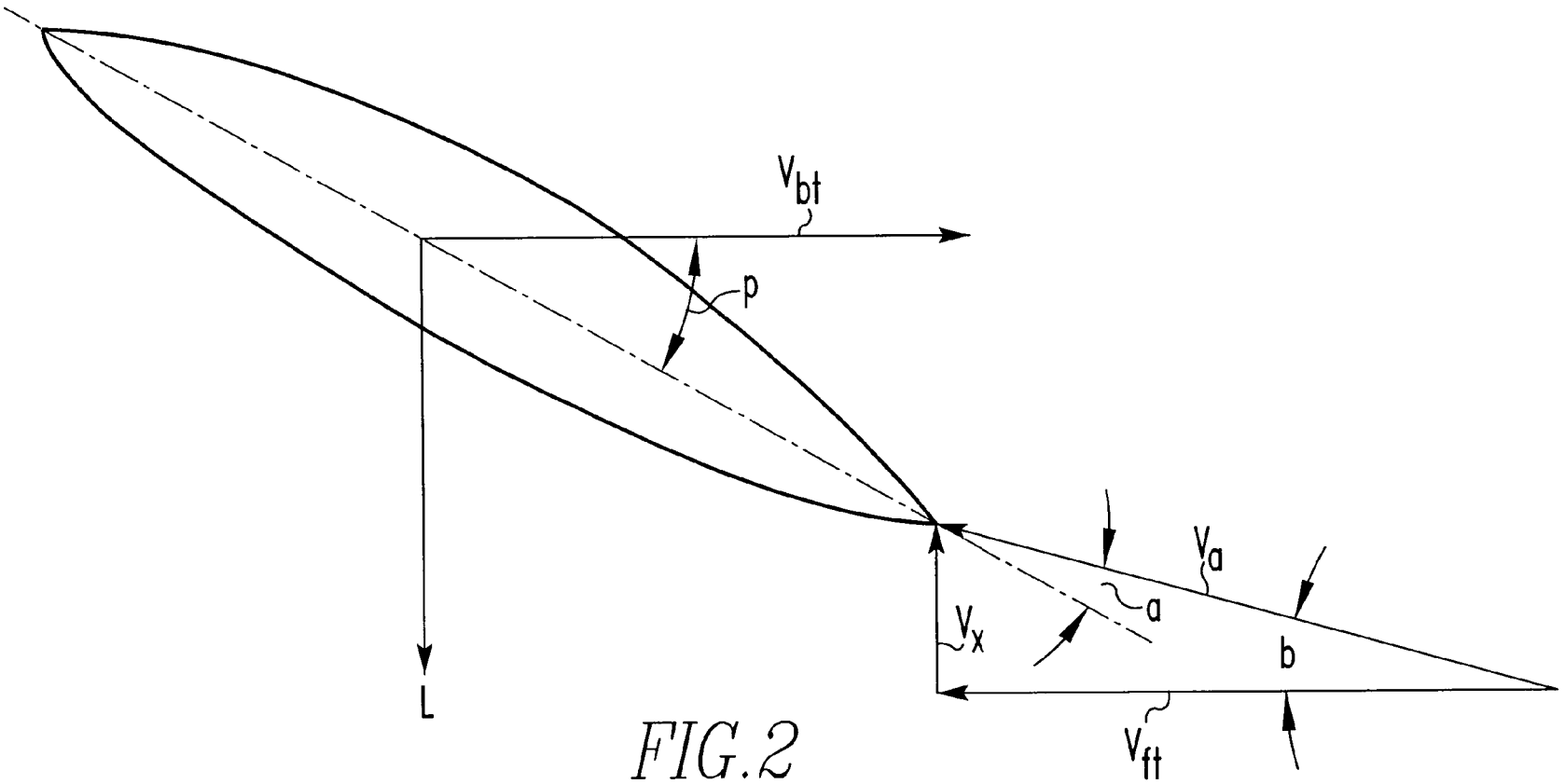
FIG. 2 is a schematic drawing showing the vector relationship of forces applicable to the present invention.

Referring to FIG. 1, the basic principle of this invention is to mitigate the effect of forward vehicle velocity (Vv) on thrust (T) by increasing the rotor speed (N) to compensate for the increased fluid velocity (Vx) in the tunnel. This principle is described in FIG. 2, which is a cross section of the propeller blade. The thrust on the vehicle is the lift force (L) the blade sections integrated over the length of all the blades. The lift force (L) and any given cross section is strongly depended of the angle of attack (a) of the apparent fluid velocity (Va) entering the leading edge of the blade.

The maximum lift will be obtained at an optimum angle of attack. Therefore, the maximum thrust will be obtained when, in an integrated sense, the angle of attack is optimum on the blades.

The apparent velocity (Va) is the resultant velocity from the vector sum of the axial fluid velocity (Vx) through the tunnel and the tangential fluid velocity (Vtf) experienced by the blade due to its rotation. The tangential fluid velocity is equal in magnitude and opposite in direction to the tangential blade velocity (Vtb). At a given cross section the magnitude is:

$$Vtf=Vtb=2\pi rN$$

where:

r=the local radius measured from the axis of rotation

N=the rotational speed in revolution per unit time.

The angle of attack is:

$$a=b-p$$

where p=the blade pitch angle.

Thus, with the blade pitch angle (p) fixed, the maximum thrust can be maintained by maintaining the optimum angle of attack, which in turn can be maintained by maintaining the optimum angle ratio of the axial velocity to the rotational speed (Vx/N).

This can be accomplished using a microcomputer to control the rotor speed. This fluid velocity-measuring device installed in the tunnel measures Vx. The measured velocity is inputted to the speed control computer 44. The speed control computer 44 is programmed to adjust the commanded motor 46 speed in response to the measured tunnel velocity input. This maintains thruster efficiency and improves the performance thruster.

The optimum Vx/N ratio can be predicted from historical propeller data of from computational analysis tools. However, the best method would be to conduct experiments on geometrically similar thruster configuration. The description above is somewhat simplified in that it ignores viscous fluid effects. The optimum Vx/N ratio may be slightly dependent on axial velocity. Using a constant ratio would provide a first order improvement in the thruster performance. If an experiment is conducted, it could be used to determine a more precise relationship between maximum thrust, fluid velocity and rotor speed and this relationship could be programmed into the control computer.

The fluid velocity-measuring device could be any device available presently or in the future. However, for tunnel thrusters that are reversible, a device that can measure reversing flow directions must be used. Examples of measuring devices that may be used are ultrasonic flow meters, magnetic flow meters, turbine meters (reversible if necessary), pitot static tubes, Kieb probes, etc. If pitot static tubes for Kiel probes are used on a reversible thruster, the two probes must be used facing in opposite directions.

Referring to FIG. 1, an alternative way to operate the speed control computer 44 is to program the controller with a formula to set the motor 46 speed based on input from a velocity measuring device 48 that indicates forward velocity of the vehicle. The formula would be derived from empirical data collected by measuring tunnel fluid velocity as a function of forward speed in an experiment. The primary advantage of this alternative is that it eliminates the need for a fluid velocity-measuring device in the tunnel. This will save the cost and maintenance associates with this device. This advantage assumes that a vehicle velocity-measuring device will be installed anyway. This approach would be appropriate if a large number of identical of geometrically similar vehicles were going to be fitted with the same or geometrically similar thrusters. Thus the cost of the experiment could be applied to all the geometrically similar configurations. This would also be appropriate for an autonomous vehicle, which already had a sophisticated control algorithm. In this case, the formula for adjusting rotor speed with forward velocity to obtain a given thrust and or control effect could be included as part of the control algorithm. The primary disadvantage of this alternative is that the controller would be responding to predicted tunnel velocity changes rather than measured changes. Also, the fault diagnosis advantages of the fluid velocity-measuring device would not be available.

The new features are the fluid velocity measuring device and the modification of the rotor speed controller to incorporate an algorithm for adjusting the rotor speed based on tunnel fluid velocity. The advantage is improved thruster performance with forward vehicle velocity. This will allow side thrusters to control the vehicle at forward speeds greater than are currently possible with current art thruster.

The inclusion of a fluid velocity measuring device will allow the thruster controller not only to respond the effect of forward velocity on thruster performance but will also allow it to respond to any unforeseen conditions that change the fluid velocity in the tunnel and maintain optimum thruster performance. For example, a piece of debris may partially or totally block the tunnel blockage of the tunnel reducing the fluid velocity. The controller would respond to this and decrease the rotor speed and maintain optimum performance.

This fluid velocity measurement device could also be part of a fault diagnoses and remediation system. A drop in tunnel velocity would be an indication of a blockage. The operator or high level controller could respond to this blockage by reversing the thruster direction in an attempt to blow the blockage out of the tunnel.

This invention could be applied to any side thruster on any water vehicle. However, it may be particularly beneficial for autonomous vehicles that do not have a human operator to respond changes in thruster performance.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A marine vehicle having enhanced maneuverability comprising:

a hull at least partially submerged in a fluid having a forward bow, and a longitudinal axis extending rearwardly from said bow and opposed first and second sides and said first and second sides having respectively a first opening and a second opening;

a fluid conducting means having a length and extending generally transversely through the hull from the first opening on the first side of the hull to the second opening on the second side of the hull;

a propeller having at least one blade on which the fluid exerts a lift force (L);

means for causing fluid to flow at an axial fluid velocity (Vx) through the fluid conducting means;

means for driving the propeller to achieve an adjustable angular speed (N);

means for measuring the axial fluid velocity (Vx); and computer means for adjusting the angular speed (N) of the propeller based on the axial fluid velocity (Vx) to approximately optimize the lift force (L) on the propeller blade.

2. The marine vehicle of claim 1 wherein there is an apparent velocity (Va) and a tangential fluid velocity (Vtf) experienced by the blade due to its rotation and the apparent velocity (Va) is the resultant velocity of a vector sum of the axial fluid velocity (Vx) and the tangential fluid velocity (Vtf).

3. The marine vehicle of claim 2 wherein there is a tangential blade velocity (Vtb), and the tangential fluid velocity (Vtf) is equal in magnitude and opposite in direction to said tangential blade velocity (Vtb).

4. The marine vehicle of claim 3 wherein at a given cross section the following relationship is applicable:

$$Vtf=Vtb=2\pi rN,$$

wherein r is the local radius measured from the axis of rotation.

5. The marine vehicle of claim 4 wherein there is an angle of apparent velocity (b), wherein, $$b=arc\ \sin\ (Vx/Vtf)+arc\ \sin\ (Vx/_{2}\pi rN).$$

6. The marine vehicle of claim 5 where there is an angle of attack (a), wherein $$a=b-p,$$

wherein p=blade pitch angle.

7. The marine vehicle of claim 1 forward vehicle velocity (Vv) has an effect on thrust (T) and said effect is mitigated by increasing the angular speed (N) to compensate for increased axial fluid velocity (Vx).

8. The marine vehicle of claim 1 wherein there are a plurality of blades and the thrust (T) on the vehicle is the lift force (L) on the blade integrated over the length of the blades.

9. The marine vehicle of claim 1 wherein the fluid conducting means has a major axis and the blade of the propeller is in generally perpendicular relation to the major axis of the fluid conducting means.

10. The marine vehicle of claim 1 wherein the propeller moves fluid from the first opening to the second opening in the fluid conducting means, and said propeller is reversible in direction to move fluid from the second opening to the first opening in the fluid conducting means.

11. A method of operating a marine vessel comprising:

a hull at least partially submerged in a fluid having a forward low, and a longitudinal axis extending rearwardly from said bow and first and second sides and said first and second sides having respectively a first opening and a second opening; a fluid conducting means having a length and extending generally transversely through the hull from the first opening on the first side of the hull to the second opening on the second side of the hull; a propeller having at least one blade on which the fluid exerts a lift force (L) for causing to flow through the fluid conducting means; means for driving the propeller to achieve an adjustable angular speed, said method comprising the steps of:

measuring the axial fluid velocity (Vx); and adjusting the angular speed (N) of the propeller based on the axial fluid velocity (Vx) to approximately optimize the lift force (L) on the propeller blade.

12. The method of claim 11 wherein there is an apparent velocity (Va) and a tangential fluid velocity (Vtf) experienced by the blade due to its rotation and the apparent velocity (Va) is the resultant velocity of a vector sum of the axial fluid velocity (Vx) and the tangential fluid velocity (Vtf).

13. The method of claim 12 wherein there is a tangential blade velocity (Vtb), and the tangential fluid velocity (Vtf) is equal in magnitude and opposite in direction to said tangential blade velocity (Vtb).

14. The method of claim 13 wherein at a given cross section the following relationship is applicable:

$$Vtf=Vtb=2\pi rN,$$

wherein r is the local radius measured from the axis of rotation.

15. The method of claim 14 wherein there is an angle of apparent velocity (b), wherein, $$b=arc\ \sin\ (Vx/Vtf)+arc\ \sin\ (Vx/_{2}\pi rN).$$

16. The method of claim 15 where there is an angle of attack (a), wherein, $$a=b-p,$$

wherein p=blade pitch angle.

17. The method of claim 11 forward vehicle velocity (Vv) has an effect on thrust (T) and said effect is mitigated by increasing the angular speed (N) to compensate for increased axial fluid velocity (Vx).

18. The method of claim 11 wherein there are a plurality of blades and the thrust (T) on the vehicle is the lift force (L) on the blade integrated over the length of the blades.

19. The method of claim 11 wherein the fluid conducting means has a major axis and the blade of the propeller is in generally perpendicular relation to the major axis of the fluid conducting means.

20. The method of claim 11 wherein the propeller moves fluid from the first opening to the second opening in the fluid conducting means, and said propeller is reversible in direction to move fluid from the second opening to the first opening in the fluid conducting means.

* * * * *